United States Patent [19]

Ellen

[11] 4,088,051

[45] May 9, 1978

[54] MUSICAL INSTRUMENTS

[76] Inventor: Leonard William Ellen, "Mapesbury", Sandy La. Northwood, Middlesex, England, HA6 3HA

[21] Appl. No.: 686,256

[22] Filed: May 13, 1976

[30] Foreign Application Priority Data

May 15, 1975 United Kingdom ..... 20570/75

[51] Int. Cl.[2] ..... G10B 1/00

[52] U.S. Cl. ..... 84/331; 84/337; 84/343; 84/1.24

[58] Field of Search ..... 84/1.01, 1.03, 1.17, 84/1.24, 1.27, 1.28, 115, 464, DIG. 6, DIG. 29; 178/50–53; 179/15

[56] References Cited

U.S. PATENT DOCUMENTS

| | | | |
|---|---|---|---|
| 3,604,299 | 9/1971 | Englund | 84/1.03 |
| 3,697,661 | 10/1912 | Deutsch | 84/1.01 |
| 3,771,406 | 11/1923 | Wheelwright | 84/464 |
| 3,842,184 | 10/1974 | Kniepkamp et al. | 84/1.01 |
| 3,865,002 | 2/1975 | Shimuzu et al. | 84/115 |
| 3,905,267 | 9/1975 | Vincent | 84/115 |
| 3,951,028 | 4/1976 | Robinson | 84/1.01 |
| 3,955,460 | 5/1976 | Southard | 84/1.17 |
| 3,971,282 | 7/1976 | Obatashi et al. | 84/1.01 |
| 3,990,339 | 11/1976 | Robinson et al. | 84/1.17 |
| 4,011,784 | 3/1977 | Fukui | 84/1.01 |

*Primary Examiner*—Robert K. Schaefer
*Assistant Examiner*—Vit W. Miska
*Attorney, Agent, or Firm*—Wolf, Greenfield & Sacks

[57] ABSTRACT

A pipe organ in which the operative condition of keys and stops is examined by time-division multiplex techniques to provide digital signals which can be transmitted to a pipe sounding section of the organ and/or recorded for subsequent transmission to the pipe sounding section of the organ, note/stop correlation between keys played and pipes to be sounded being effected by modification of the transmitted digital signals.

11 Claims, 9 Drawing Figures

MUSICAL INSTRUMENTS

SUMMARY OF THE INVENTION

Thus, it is a purpose of this invention to provide a pipe organ in which the conventional multi-wire cable connecting the console to the pipe-chamber (commonly many hundreds of wires) can be replaced by one pair of conductors or a radio link; and to facilitate provision of correlation between keys and 'stops' without the need for a great number of relay contacts or their equivalent. It is another purpose of the invention to enable a pipe organ to be recorded in such a manner that the organ itself regenerates its sounds on playback, in the manner of the player-piano or pianola but with the necessary signals recorded on magnetic tape instead of punched paper and with the ability to cope with the full facilities of a pipe-organ of any size.

Yet another purpose of the invention is to facilitate the provision on an organ of extra features which have hitherto been impracticable or unacceptably expensive.

The console of a pipe-organ comprises a large number of electrical switches which are controlled by the organist. There is a wide range of sizes of such instruments, having from two to five or more manuals usually to 61 notes each and a pedal board of up to 32 notes. Some or all of the notes may be arranged to have what is known as a second touch by means of which the organist is enabled to energise additional sound generators by applying additional pressure to the keys. There are also a number of switches known as "stop-keys", "stops", or "tab-switches" by means of which the organist may couple various ranks of pipes and other sound generators to the keyboards, and control special functions such as the coupling together of the keyboards. Further switches controlled by swell pedals are frequently provided, which operate shutters in the pipe-chambers. The total number of electrical switches is commonly several hundred and may be more than a thousand, requiring a correspondingly large multi-wire cable between the console and the pipe-chamber if the instrument is constructed according to already-established methods.

The invention eliminates the need for the multi-wire cable by time-sharing one pair of wires or a small number of wires between the multiplicity of console switches and keys and exploits the capabilities of the time-sharing system to provide in a simple and economic manner a number of desirable features including the recording of signals in digital form on magnetic tape or disc and subsequent playback.

BRIEF DESCRIPTION OF THE DRAWINGS

There follows a detailed description of a preferred embodiment to be read with reference to the accompanying drawings which are given by way of example and in which.

GENERAL DESCRIPTION OF THE INVENTION

Figure 1:
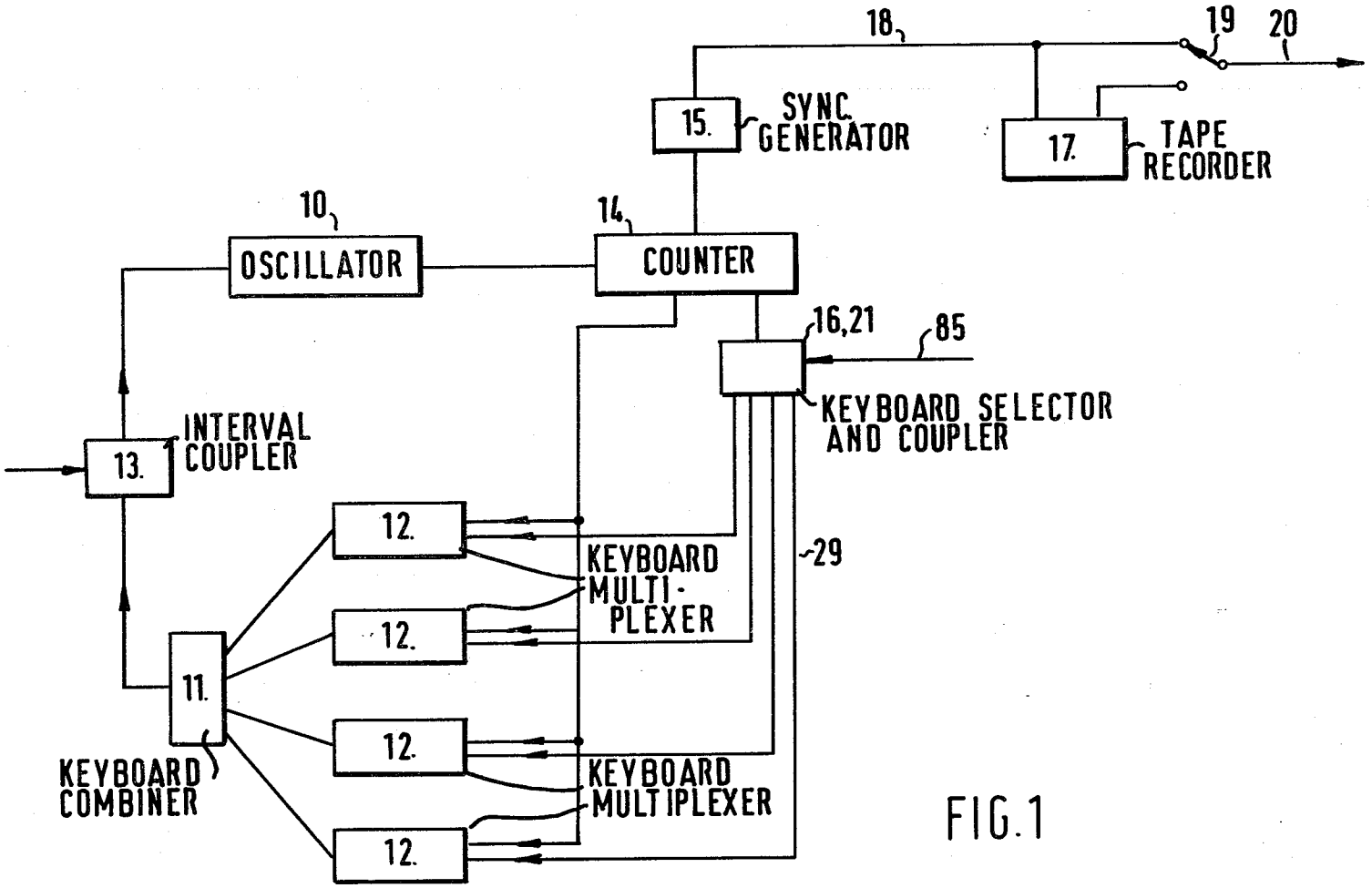
FIG. 1 is a block diagram of a console transmitter of a pipe-organ of the invention.

As will appear hereinafter, the invention uses the principle of time-division multiplexing.

A highly skilled musician is not capable of playing sequentially more than a few tens of notes per second and it therefore suffices, in a multiplexed interrogation of the note status, if each note of an instrument is examined electrically about 50 times per second to determine whether it is "on" or "off". It is well-known that electrical impulses can be transmitted along a pair of conductors or by radio at the rate of many millions of impulses per second and it is therefore possible to examine sequentially many thousands of switches sufficiently often to enable information sufficient to describe the musician's operation of the keyboards to be transmitted to the pipe-chamber or other receiver with a time-lag which is too small to be detected by the human ear. Integrated-circuit devices capable of generating, processing and detecting suitable signals are readily available, for example the Texas Instruments SN 74 series, and for the purpose of immediate transmission over short distances speeds are easily attainable to deal adequately with as many switches as are likely to be required for the present purpose.

If it is desired to record the multiplex signals, high speeds are less easily attained at low cost and it becomes desirable to effect economies. The scanning rate may then be reduced somewhat if the lowest possible cost is desired. Furthermore, in the case of the organ, only the piano-like keyboards need to be scanned at a high rate and an economy can be effected by arranging that the auxiliary switches such as stop-keys and swell pedals are scanned less frequently. In digital circuitry it is often convenient though not essential to allocate channels on a binary basis, and a 61-note organ manual may conveniently be regarded as a 64-channel unit for design purposes. Thus an eight-bit system giving 256 channels may be regarded as three groups of 64 channels each to serve three manuals, a group of 32 channels to serve a pedal board, and a group of 32 channels to be used in turn by as many groups of stop-keys and auxiliaries as may be needed. Using a method to be described later a very simple single-channel tape recorder mechanism can be used to provide a typical three-manual organ with a system giving at least 30 keyboard scans per second, say, 256 stop-keys scanned about four times per second. A more sophisticated taperecorder using a higher tape speed and/or multi-track recording will serve a much larger organ and/or allow more frequent scans.

The organisation of the multiplexing system is capable of many variations to suit particular needs and a binary system is not essential to the invention.

The digital information derived from the sequential examination of the switches is transmitted to the pipe-chamber and/or is recorded by means of a series of electrical impulses.

The channels are examined sequentially and a simple signal relevant to each and every channel is transmitted or recorded to indicate whether the relevant switch or key is on or off. The signals may take a number of different forms such as amplitude, frequency, or phase modulation of a carrier wave, or, having regard to the fact that the transmission distances involved are short, direct transmission of the pulses is possible without recourse to the use of a carrier.

For the purpose of recording at low cost, it is desirable that the signals be confined to a single pathway and that the system should not require a high degree of amplitude or frequency stability. The preferred method of transmission and recording is therefore by pulse duration modulation. A dc voltage applied to the transmission line and/or to the magnetic recording head in a recorder is given a stop-like change of magnitude or is reversed in polarity. For transmission by line, on/off switching suffices but for magnetic recording it is desirable to reverse the polarity. The signal is switched at each step of the multiplexing counter but the time interval between switchings is made dependent upon the state of the relevant key or switch. When the channel is "off", the time interval is a minimum, typically 125 microseconds for a transmission rate of 8,000 bits per second, and this is increased, for example by 50%, when the relevant channel is "on". When appropriate, "second touch" is signalled by a greater increase of pulse duration, for example 100%. A wide variation between the three signals reduces the number of errors due to random timing variations and thus permits the use of an inexpensive tape mechanism, the system being unaffected by substantial amounts of "wow" and "flutter". If required, channels may be used on an analogue basis in association with a touch-sensitive keyboard. Modulation of the pulse duration may be achieved, for example, by altering the voltage applied to the base resistors of a relaxation oscillator of the "multivibrator" type i.e. an astable pair, used to drive the multiplexing counter. Pulse-duration modulation has the effect of modifying the overall scan time according to the number of channels which are "on", but this is acceptable.

At the receiving end of the system a demodulator and demultiplexer are provided, a simple system for the detection of pulse-duration modulation being as follows:

The signal is applied to two monostable circuits, directly to one and via an inverter to the other, so that each reversal or step-change of amplitude triggers one or the other monostable circuit, giving rise to short pulses which are combined in a 2-way gate to drive the counter of the receiver one step at each reversal or amplitude change. The output of the gate also discharges capacitors used to time the intervals between signals. One such timer is arranged to trigger at a point midway between the duration of an "off" channel and the duration of an "on 1st touch" channel, while another timer distinguishes between "on 1st touch" and "on 2nd touch". A third timer responds to a much longer duration signal inserted once per scan to synchronise transmitter and receiver.

The transmission system can be made to have an extremely low error rate, but there is some risk of errors in the recording system. The effect of non-recurring errors is not serious even if they are not detected, but the effect may be reduced by a simple error-detecting system. Spurious additional signals cause apparent shortening of received pulses, and loss of a signal is necessarily followed by loss of the next signal resulting in a pulse of at least three times normal "off" duration and at least 50% longer than a "2nd touch" duration. Such abnormal pulse durations are detected by appropriate timing circuits and used to disable the decoding system until the next synchronising pulse is received; until then all channels in the receiver are held in their existing state so that a single random error will usually have no effect and at worst will merely delay a change of state by the duration of one scan, which is almost undetectable by the human ear.

A pipe-organ consists of a number of ranks of pipes, each rank consisting of a number of pipes of similar tonal qualities but different pitch, different ranks having different tonal qualities. The ranks are usually arranged to allow coupling to two or more keyboards both at normal pitch and with displacement of pitch of one or more octaves or other musical intervals. In previous systems of control such multiple couplings require the provision of multi-contact relays, usually with 61 pairs of contacts in the case of a full rank coupled to a 61-note keyboard, or an equivalent multiplicity of two-way gates. Such systems lead to a very large amount of electrical equipment and wiring associated with the pipes.

This invention allows the relay or gating system to be retained for use with the time-division multiplex system if desired but it also allows the desired couplings to be effected without recourse to the use of such relays or multiple gating systems by taking advantage of the high speeds obtainable with the use of electronic circuitry. In this invention the time allocated to each channel of the time-division system depends upon the size of the organ and the scan rate chosen but it will not be less than several tens of microseconds. The circuit elements used are capable of responding in much less than one microsecond and are therefore easily capable of being switched many times within the time allotted to a single channel. An "adder" such as Texas SN7483 may therefore be included in the demultiplexer and used to change the "address" by, for example, 12 24 31 36 and 40 units in rapid succession in order to change the selected pipe to, successively, the 16ft, 8ft, 4ft, 2⅔ft, 2ft, and 13/5ft pitch or other pitches as required. Each pipe is equipped with a double latch giving a "hold and store" facility, the latch being energised whenever a combination of decoded address and added mdification corresponds to an "On" note and an "On" stop-key. After each complete scan the held information is transferred to the store latch which energises the relevant pipe-magnet via a driving transistor and the hold latch is reset for the next scan. As the notes are dealt with sequentially and not simultaneously, only one gate is needed to couple a complete rank at a given pitch on a given keyboard.

The latching system for each rank of pipes may conveniently be mounted on or near the corresponding wind-chest and by providing each rank with a separate address-demultiplexer each rank is made self-contained, requiring a maximum of 7 address wires common to all ranks plus one "enable" wire for each rank individually instead of requiring a separate wire for each pipe, which would amount to nearly a hundred wires for a full rank, wired through a multiplicity of 61-contact relays. The "enable" wire is strobed to prevent overlapping of signals.

The use of the time-division multiplex system of this invention permits the simple and cheap provision of a large number of facilities, a single circuit element being able to carry out its function on each channel in sequence instead of being replicated to deal with many channels simultaneously. In general it is possible to provide, usually at small cost, any facility desired by the organist provided that the requirement can be stated in logical terms. It is therefore not possible to give an exhaustive list of possible facilities, but a brief description follows of some facilities which are likely to be of general use.

1. Interval coupling. It is often desired to arrange that any note played, additionally sounds a specified musical interval such as an "octave" above or below its true pitch. Such a musical interval can be specified in technical terms as a given number of semitones, that is consecutive notes, but the number of semitones does not correspond with the musicians terminology. For example, an "octave" is an interval of 12 semitones; a "fifth" is an interval of 7 semitones. If the multiplexed signal for a given note is directed to the input of a shift register which is stepped at the same rate as the multiplex counter it may be returned to the signal pathway any desired number of time-steps later when it will be equivalent to a correspondingly higher note, assuming the direction of scan to be upwards. Couplings to a lower note is achieved by delaying all normal (i.e. "unison") signals by means of a shift register; a signal picked off an earlier stage of the register then represents a lower note. Several different musical intervals may be thus coupled simultaneously and thus provision may be made for the automatic generation of multi-note chords based upon a "root-note" defined at any point on a keyboard. By returning the "octave" signal, that is the signal from the 12th stage of the shift register, to the input of the register a multiple coupling is achieved giving the desired musical intervals repeated at octave spacings. The shift register is cleared at the end of each keyboard scan unless coupling to the next keyboard is desired.

2. Arpeggio and scale generation. By adding varying gating signals to the multiple coupling facility already described, the notes of a chord are sounded in sequence instead of simultaneously, thus generating an arpeggio. By applying the same method to a chord consisting of all the notes of a major, minor, or chromatic scale the corresponding scale is generated. The chords may be played as such by the organist or may be generated automatically from a root-note as already described.

3. Manual-to-manual and manual-to-pedal coupling. It is usual to arrange couplers so that the organist can at will cause a keyboard to sound notes which are proper to other keyboards. According to this invention the switches of each keyboard are joined to a common wire which is energised by the multiplexer during the appropriate period of each complete scan. If the common lead of one keyboard is energised during a period normally allotted to another key-board then the former will function as if it were the latter, thus effecting the desired coupling. This is achieved by single-pole switching of the common leads, thus eliminating the need for additional contacts on each note of the coupled keyboards. Alternatively, coupling may be effected by similar switching at the receiver in the pipe-chambers activated by signals transmitted over stop-key channels. Manual-manual coupling and interval coupling may be combined to provide manual-manual coupling with interval displacement.

4. Keyboard splitting. In the system of the present invention it is a simple matter to change the energisation of the keyboard common leads during a keyboard scan thus allowing different parts of a keyboard to sound different combinations of pipe-ranks. The points on the keyboard at which the splits occur may be arbitrarily fixed or may be determined by means of an electronic memory which may be set by the organist operating a setting switch and depressing the keyboard notes at the desired points of split.

5. Note separation and chord expansion. A keyboard musician is subject to the physical limitations of his hands and he is therefore unale to play chords requiring a large finger span; for example many organists and pianists cannot satisfactorily play a musical "tenth" which requires a finger span of over 8 inches on a standard keyboard. According to this invention each note is processed separately and it is therefore possible to give different treatment to each note of a chord according to a pre-arranged system. Thus a "third" played on a keyboard may be caused to sound as a "tenth" by arranging that the lowest note of a chord is processed normally but the second lowest note is disconnected from the normal unison path and diverted via a shift register as already described to sound an octave higher. This principle is extended to any desired degree. For example alternate notes of a chord may be raised an octave thus expanding the close harmony which can be played with one hand to an open harmony which would otherwise demand the use of two hands. Similarly the separate notes of a chord may be directed to different ranks of pipes, with or without displacement of pitch.

6. Key transposition. According to the invention key transposition can be done automatically with little extra complication. One method is by using a shift register to delay all keyboard signals by a desired number of steps; another method is by using an adder to modify the addresses to which the signals are directed by the demultiplexer. Gating circuits are provided to inhibit transposition during stop-key scanning to prevent unwanted transposition of stop-key channels.

7. Modification during playback. During playback of a digital recording the driving oscillator of the console transmitter is disabled and the console multiplexer is slaved from the recording, thus enabling signals from the console to be mixed with the signals from the tape playback. It is arranged that such signals may be mixed on an additive or subtractive manner thus enabling the recorded material to be modified on playback without changing the signals recorded on the tape. For example one or some or all the signals correponding to the recorded stop-key settings, including transpositions, may be suppressed and replaced by new settings. Similarly individual notes or complete keyboards may be suppressed and replaced.

DETAILED DESCRIPTION OF THE PREFERRED EMBODIMENT

A description of an embodiment in a typical 3-manual organ will be given, but it should be understood that very many variations are possible in detail while still using the basic system. For example, multiplexing is described in terms of an 8-digit binary system using 6 digits to control a keyboard multiplexer consisting of a $4 \times 16$ unit and using the remaining 2 digits to select four such multiplexers one at a time. The keyboard multiplexers could equally well be $8 \times 8$ units, or even $6 \times 12$, and a single multiplexer could serve all keyboards if the keyboards were given access via multiple gates.

The embodiment described uses a bit-rate of about 13,000 per second, equivalent to a nominal channel period of 75 microseconds ($\mu$S); but the speed would be adjusted to suit the characteristics of a particular instrument, in which case other parameters would also be changed. The speed and configuration of the multiplexers would certainly be different for, say, the piano.

Unlike the piano, in which a particular key always strikes the same string(s), each key of an organ keyboard is capable of sounding many different pipes, of different tonal qualities (i.e. different 'ranks') and of different pitch (i.e. 'footage'). There are at least two, usually three and sometimes more, manuals and a pedal keyboard and each of several ranks of pipes may be accessible from any one or more keyboards. Furthermore, each rank may be accessible at several different footages; that is to say, a keyboard note may sound a pipe of true pitch appropriate to that key or an octave below or one two or three octaves above true pitch or in some cases fractions of an octave different from true pitch.

In orthodox systems, the notes of the keyboards are coupled to the magnets which energise the pipes via an array of relays which need to have a separate 'make' contact pair for each of the notes of a keyboard, the relays being controlled by the switches referred to above and known as 'stop-keys' 'drawstops' or 'tabswitches'. The simultaneous operation of, typically, 61 contact pairs requires a substantial force which is often obtained by the use of compressed air. Recently, the electro-mechanical or electro-pneumatic relays have been replaced by electronic gates but these have been provided on the basis on one gate for each stop/note combination i.e. a stop associated with a 61-note manual requires 61 gates and each such stop requires 61 wires connecting to the appropriate manual and 61 wires connecting to the pipe electromagnets, this resulting in a complex network of wiring.

In th new system, a simple demultiplexing system is provided for each rank of pipes, controlled by a master receiver and a footage controller common to all ranks of pipes. Instead of each rank needing a separate wire to connect each pipe to each relevant relay or gate, all ranks are connected to the controller by nine wires common to all ranks and one wire individual to each rank. Seven of the nine wires select, on a binary basis, the appropriate pipe of each rank simultaneously and the master controller transmits a short pulse on the individual control wire to each rank whose pipe is required to sound. A latch system converts the pulse to a sustained signal until cancelled by a signal on the other two common wires.

During the period allotted to each note of a keyboard (during which the scanner does not step on) the 6-bit address furnished by the receiver is modified by an 'adder' to several different related addresses in rapid succession to correspond with the various footages which may be required. The basic address from the receiver supplies the address of the pipe corresponding to the lowest pitch (longest footage) at which the rank may be used, normally the 16 foot pitch. This address is connected to one set of inputs of the adder; the other set of inputs of the adder is fed with a series of binary numbers corresponding to the number of semitones (notes) by which the basic address has to be increased in order to select the pipes appropriate to the various footages. Thus, at the said other set of inputs of the adder, for 16 foot zero is added, for 8 foot 12 is added, for 4 foot 24 is added and so on, a rise of twelve semitones being equivalent to halving the footage. Seven semitones gives 2/3rds of the footage and four semitones gives 4/5ths of the footage, these being related to the so-called mutation stops.

Eight different footages are usually sufficient, but any number can be provided. In the embodiment to be described a period of 5$\mu$S is allowed for each footage, allowing about 8 to 10 footages to be dealt with comfortably within the 75$\mu$S period allotted to each note.

Only one footage adder is required for the whole organ, and only one 3-way gate is required for each stop, as described later.

As each rank is usually controlled by at least two stop-keys it is necessary to provide a double-latch system to sustain the energisation of each pipe-magnet. This is described later.

Standard components such as capacitors, resistors and transistors will not be specified in detail herein and their value, tolerances and ratings will be easily calculated by persons skilled in the art. The practicability of the system depends on digital integrated circuits. These are made by several manufacturers in at least two basic types and are readily available. A well known series of digital integrated circuits is the SN 74 series of TTL logic devices made by Texas Instruments, but other types could be used subject to detail changes in the design not affecting the general principles. In view of the general familiarity of engineers with devices of the SN 74 series, references to such devices are given in the following description, together with the function description, where desirable. Some of the devices are multiple-unit packages, but this is ignored as it is a practical matter well-known in the art. Other standard matters such as power supplies are treated similarly for the same reason.

The embodiment which is the subject of this description is an organ with three manuals of 61 notes each, 32 pedals and up to 30 stop-keys. The basic instrument will be described first and separate descriptions will be given for extra features which may be added, including digital recording and playback.

In FIG. 1, which is a general diagram of the organ console transmitter, an oscillator 10 is shown, which is modulated by signals from a keyboard combiner 11 which receives output signals from keyboard multiplexers 12. In the signal path from the keyboard combiner 11 to the oscillator 10, an interval coupler 13 is provided for coupling notes a fixed distance apart on any given keyboard, as will be described later, the signal from the oscillator 10 is fed to a binary counter 14 which has outputs for addressing and enabling the multiplexers. The counter 14 also controls operation of a sync generator 15 and a keyboard selector and coupler 16. Signal output from the transmitter is fed to a tape recorder 17 by a line 18 and a switch 19 allows either the line 18 or the tape recorder output to be switched to a line 20 extending to the pipe chamber.

For convenience of design using a binary multiplexing system each manual is regarded as a 64-channel unit and the pedals plus stop-keys are treated as a further such unit. Thus the three-manual organ requires four 64-channel units of multiplexing giving a total of 256 channels, that is to say an 8-digit binary system. The zero channel of the manuals multiplexers is not used, and the zero channel of the pedals-and-stops multiplexer is used for synchronising purposes. The notes of the manuals are numbered 1–61, binary *xx*000001 to

*xx*111101 where *xx* represents two binary digits specifying the individual multiplexers; 62 and 63 are unused. The pedals use channels 1–32 of their multiplexer whose prefix digits are 00, that is, binary 00 000001 to 00 100000. The stop-keys use channels 34–63 of this multiplexer, binary 00 100010 to 00 111111. Channel 0, binary 00 000000, is the sync pulse and channel 33, binary 00 100001, is used to cancel the stop-key latch settings in a manner to be described later.

The sync pulse is distinguished by being increased in duration by the equivalent of 8 channels, so the total equivalent channel-units of time is 264. These are to be scanned about 50 times per second, giving a scanning rate of approximately 13,200 channels per second, which may be regarded as a nominal time of 75μS per channel.

Figure 3:
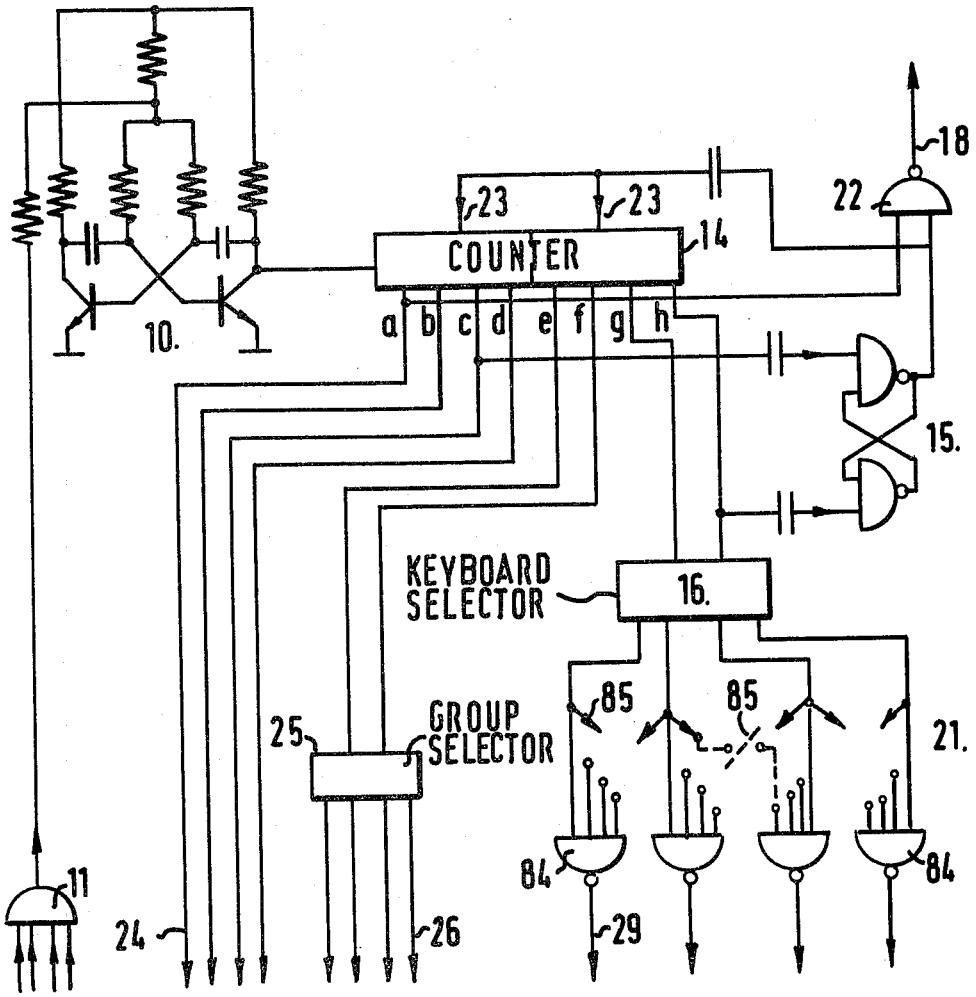
FIG. 3 is a detailed block circuit diagram of a control unit forming part of the transmitter of FIG. 1.

FIG. 3 shows the arrangement of the control unit, including the sync generator 15 and also showing keyboard couplers 21, for the console. The digital scanning signals are derived from oscillator 10 which is of the relaxation type e.g. a multivibrator running at about 13,200 Hz.

Figure 4:
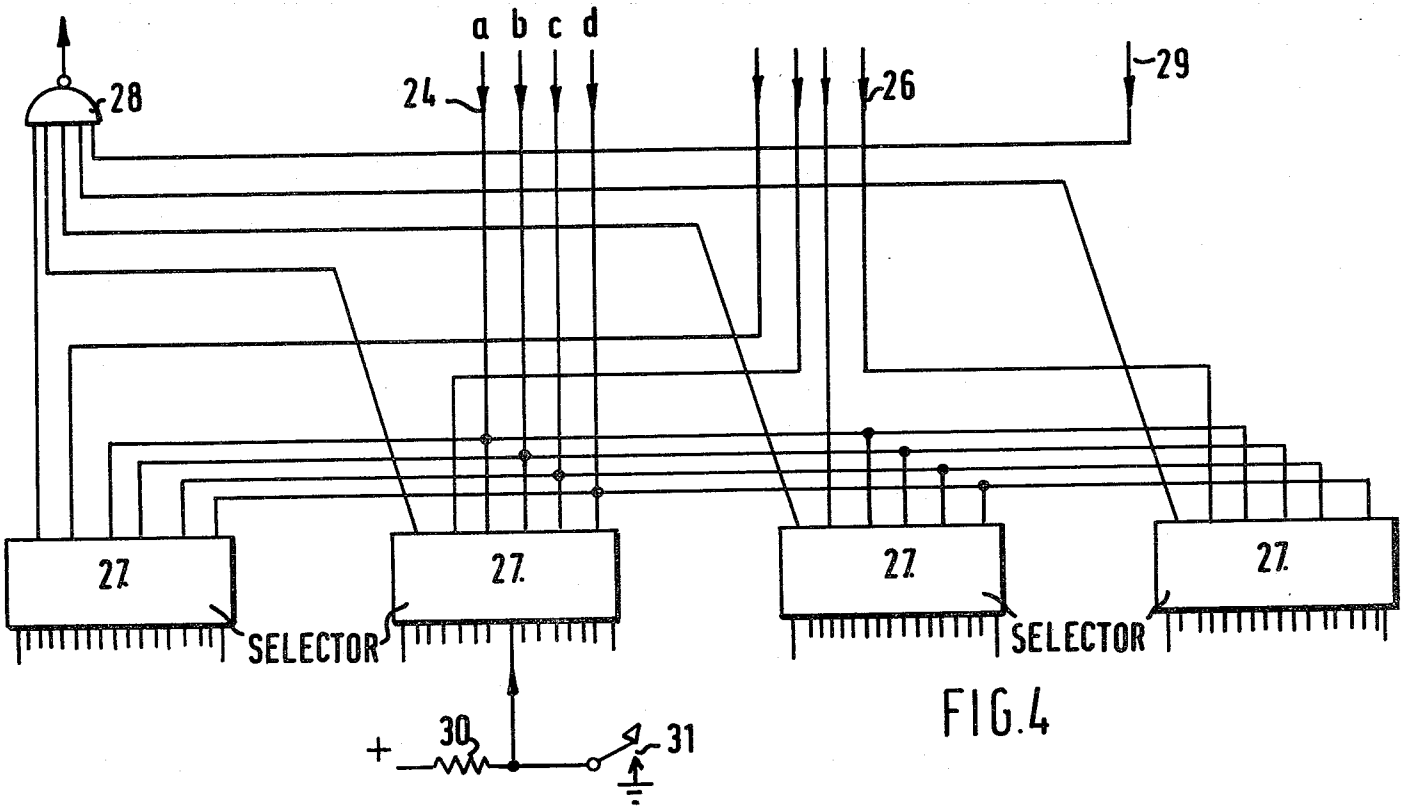
FIG. 4 is a detailed block circuit diagram of a keyboard multiplexer, a plurality of which form part of the transmitter of FIG. 1.

Modulating signals are fed to the oscillator 10 from the keyboard combiner 11 which is a 4 way AND-gate (SN 7421) the inputs of which are supplied with signals from keyboard combiners of the keyboard multiplexers 12 (see FIG. 4).

The oscillator 10 drives the counter 14 which is an 8-digit binary counter composed of two SN7493s, whose outputs will be designated *a,b,c,d,e,f,g* and *h* in that order of significance. At the end of each scan when *h* changes from 'high' to 'low' a latch, forming part of the sync generator 15 and consisting of two NAND gates (SN 7400), is set whereupon a gate 22 (SN 7400) inhibits further transmission to line 18 until the latch 15 is reset by a similar transition of the *c* digit, 8 steps later, when the counter 14 is set back to zero by reset signals 23 and transmission is resumed. Thus a synchronising signal is generated.

Lines from the *a, b, c* and *d* outputs of the counter 14 constitute address lines 24 for the multiplexers (FIG. 4). Lines from the *e* and *f* outputs of the counter 14 run to a group selector 25 (SN 74155) which is a dual 2 to 4 line decoder, its four outputs being connected to group enable lines 26 of the multiplexers (FIG. 4).

FIG. 4 shows one of the four 64-channel multiplexers for a manual or for pedals-and-stop-keys. The multiplexer consists of four 16-bit data selectors 27 (SN74150) and a NAND-gate 28 (SN7430). The four address inputs of all the selectors 27 are connected to the *a,b,c* and *d* outputs of the 8-digit counter 14. The four outputs of the group selector 25 in the control unit (FIG. 3) are used to 'enable' each of the selectors 27 in the 64-channel multiplexers in turn. Thus, as the six digits, *a* to *f*, of the counter 14 pass through the 64 combinations 000000 to 111111, the inputs of the four selectors 27 are put, sequentially, in control of the outputs. These outputs are connected to four of the inputs of the NAND-gate 28. The NAND-gate 28 has eight inputs and the remaining four inputs are connected together (a 5-way gate would suffice but is not available) and these four inputs form a keyboard control line 29 which is raised to 'high' potential when it is desired to scan the relevant keyboard.

The keys (i.e. the 'notes') of the keyboards each have a normally open, i.e. "make" pair of contacts. One of each pair is grounded (i.e. connected to the negative supply rail) and the other is connected to the appropriate input of the multiplexers according to the numbering scheme already described. Each input should also be connected via a resistor 30 of about 1000 ohms to the positive (5 volt) supply rail to ensure that it does not 'float' when the key is not depressed, a typical key or stop-key being indicated by reference numeral 31. The overall result is that the output of the NAND-gate 28 responds to the state of the key selected provided that the multiplexer is enabled by the keyboard control line 29; when not so enabled the output of the NAND gate 28 is 'high'.

Four of these 64-channel multiplexers form the whole multiplexer for the organ. Basically they are enabled in turn by the *g* and *h* digits of the 8-digit counter 14 operating via a further dual 2 to 4 line decoder (SN74155) forming the keyboard selector 16 (FIG. 3), the *gh* digits being 00 for the pedals and stop-keys and 01, 10 and 11 for the three manuals, but this arrangement being modified by the keyboard couplers 21, which will be referred to later in a discussion of additional features.

The outputs of the NAND-gate 28 in each of the four multiplexers are combined in the 4-way AND gate constituting the keyboard combiner 11 (FIG. 3), whose output forms the final output of the complete console multiplexer.

This final output is used to modulate the time period of the oscillator 10 which drives the multiplexer. When the selected note or stop-key is 'off' the final output is 'high' and the oscillator period is approximately 75μS, but when the note or stop-key is 'on' the potential on the oscillator's base resistors is reduced and its period is thereby increased to about 150μS. Other forms of modulation are possible, but this method is preferred because it minimises the risk of errors in recording and allows a simple method of detecting residual errors. An output to line 18 is taken from the first stage of the counter 14, the *a* output, whose potential alternates between low and high for alternate channels; the gate 22 allowing injection of the sync pulse as already described.

Figure 9:
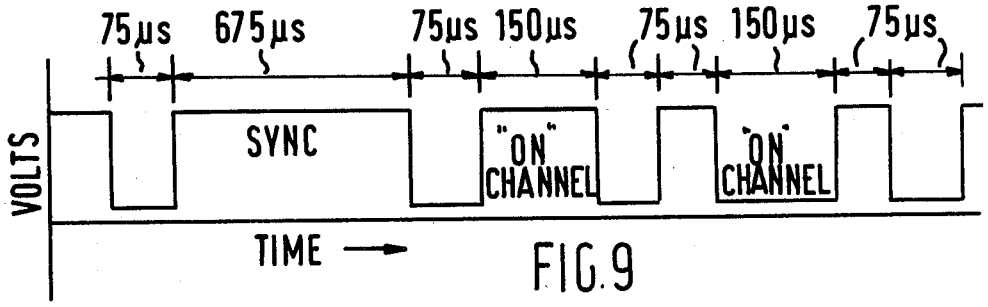
FIG. 9 illustrates a typical waveform of a line output signal of the transmitter of FIG. 1.

A typical waveform of the output to line 18 is shown in FIG. 9. The wide differences in duration of the off, on, and sync signals enable the system to tolerate gross amounts of wow and flutter in the recording system. For short distances between the console and the pipes, this signal may be connected direct to line 18, but for longer distances a line-driver-amplifier (not shown) may be needed such an amplifier may be formed by a SN 75450B circuit.

Figure 2:
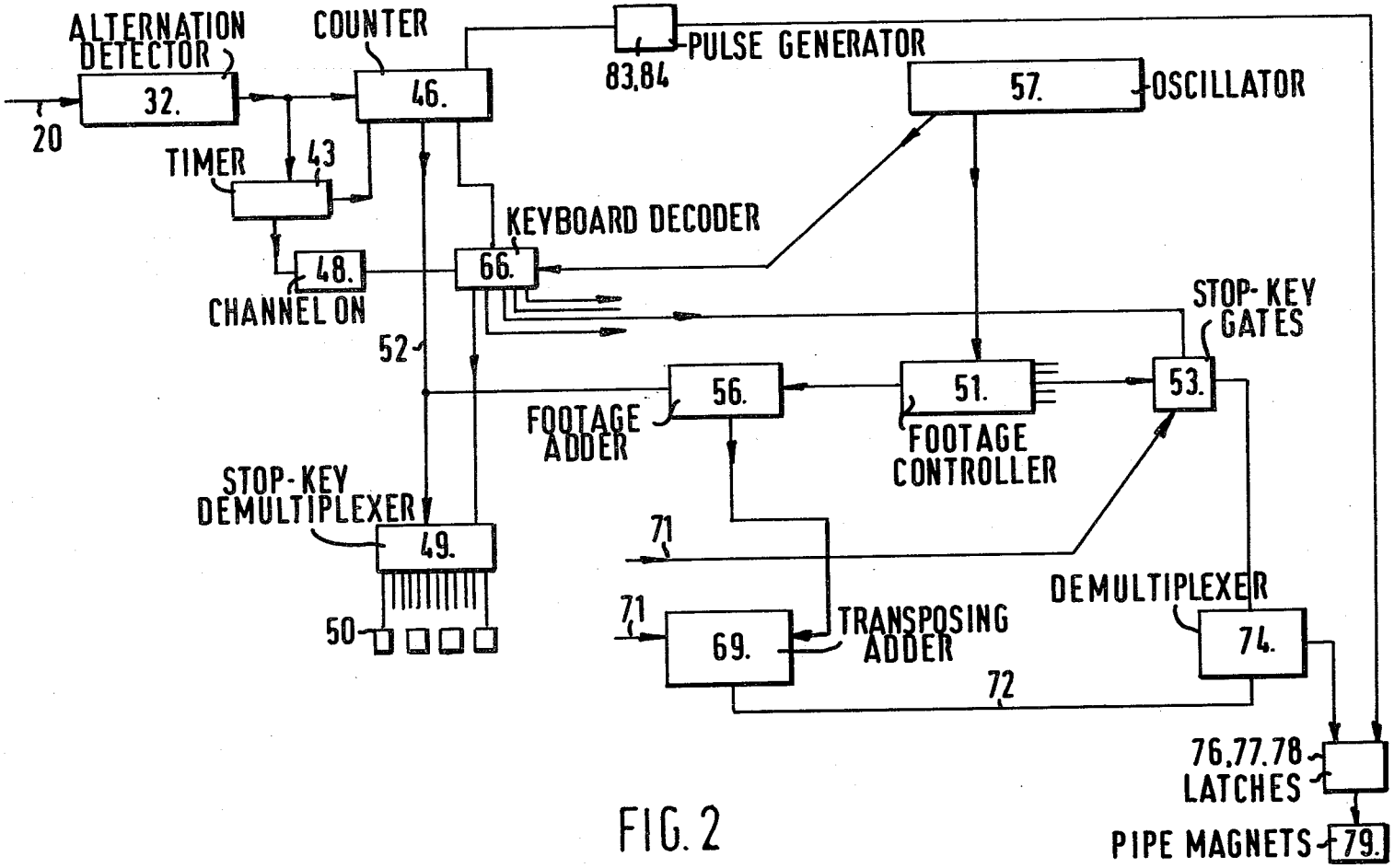
FIG. 2 is a block diagram of a signal receiver and footage control unit of the pipe-organ.

In FIG. 2 which is a general diagram of the receiver, the interrelation between various components of the receiver is illustrated. Individual parts of FIG. 2 are shown in greater detail in FIGS. 5, 6, 7 and 8 and further reference will be made now to those figures.

Figure 5:
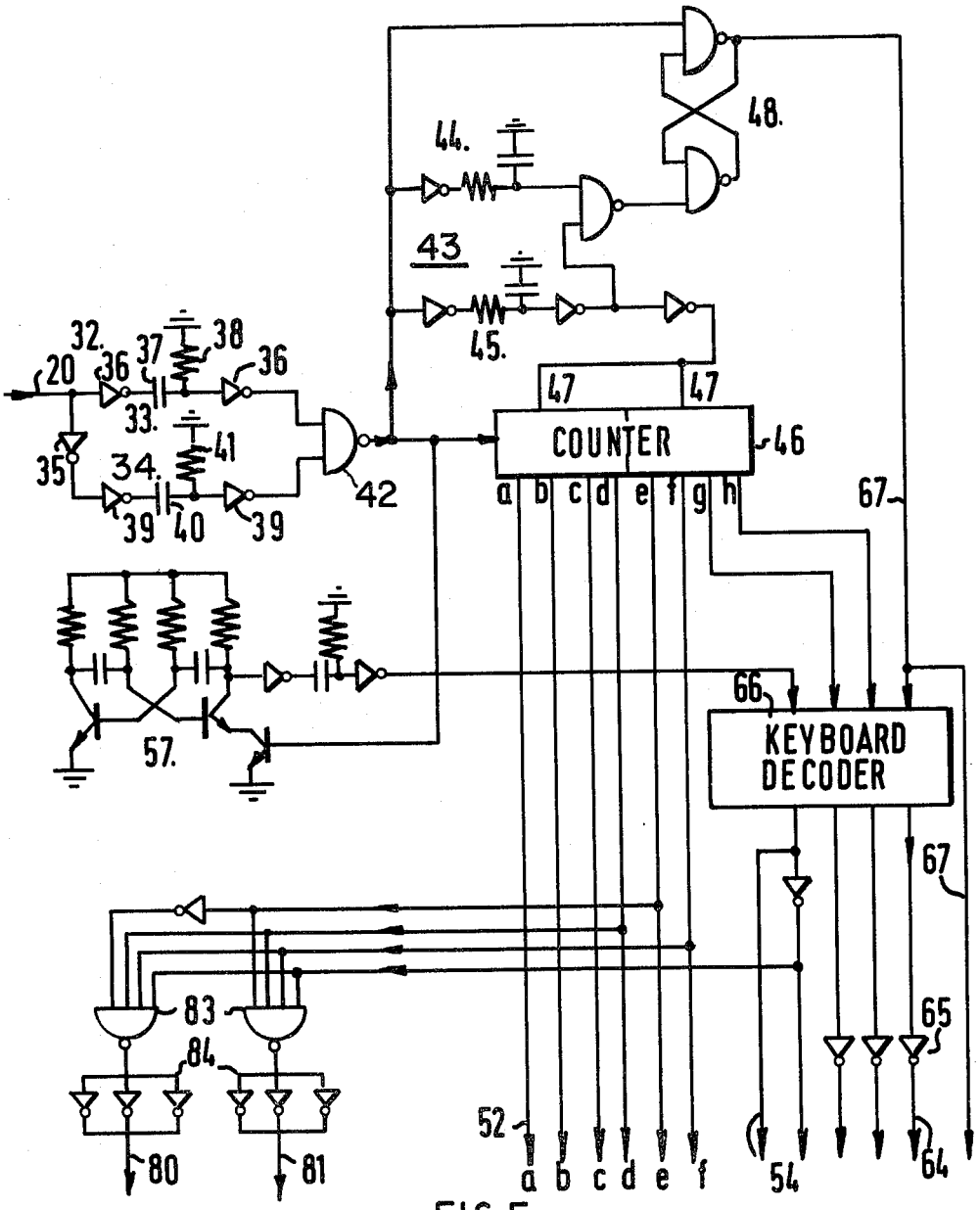
FIG. 5 is a detailed block circuit diagram of the receiver of the unit of FIG. 2.

FIG. 5 shows the arrangement of the receiver, which is provided in the pipe chamber. It comprises an alternation detector 32 having two pulse generators 33 and 34 one of which is driven directly by the incoming signal on line 20 and the other by the line signal inverted by an inverter 35 (SN 7404). Pulse generator 33 consists of two inverters 36 (SN 7407) coupled by a capacitor 37 whose value is chosen to give, in combination with its associated resistor 38, a pulse of about 50μS. Pulse generator 34 consists of two inverters (SN 7404) coupled by a capacitor 40 whose value is also chosen to give, in combination with its associated resistor 41, a pulse of about 50μS. The duration of the pulse is not critical, but the two should be equal within about 10%. One of the generators gives a pulse when the line potential goes from high to low, the other when the line goes from low to high. The two are combined by means of a 2-way gate 42 (SN7400) whose output gives a 50μS pulse of high potential at each alternation of the line potential. Line alternations occur at intervals of approx 75μS for 'off' channels, 150μS for 'on' channels and 675μS for the synchronising signal and the corresponding intervals between the 50μS pulses are therefore nominally 25μS, 100μS and 625μS.

The 50μS pulses control a timer 43 having two timing circuits 44 and 45 respectively consisting of a capacitor a resistor and a voltage level detector. During the 50μS period the two capacitors are rapidly discharged and they recharge during the intervals between pulses. If and when each reaches a predetermined voltage level a signal is generated by the relevant level detector. The capacitors and resistors are chosen so that the critical voltage is reached in approximately 70μS and 300μS respectively, the former signifying receipt of an 'on' channel signal and the latter a sync signal.

The 50μS pulses are also used to drive an 8-digit binary counter 46 (two SN7493s) which is arranged to step forward at the end of each 50μS pulse. On receipt of a sync pulse on its inputs 47 from the timing circuit 45, the counter 46 is immediately set to zero. Thus the counter 46 of the receiver is driven in synchronism with the counter 14 of the transmitter. There is, however, a difference of 50μS so that the footage controller referred to hereinafter can perform its function after detection of an 'on' signal by the timing circuit 44 the 'on' signal being retained in a latch 48 composed of SN 7400 elements.

Figure 7:
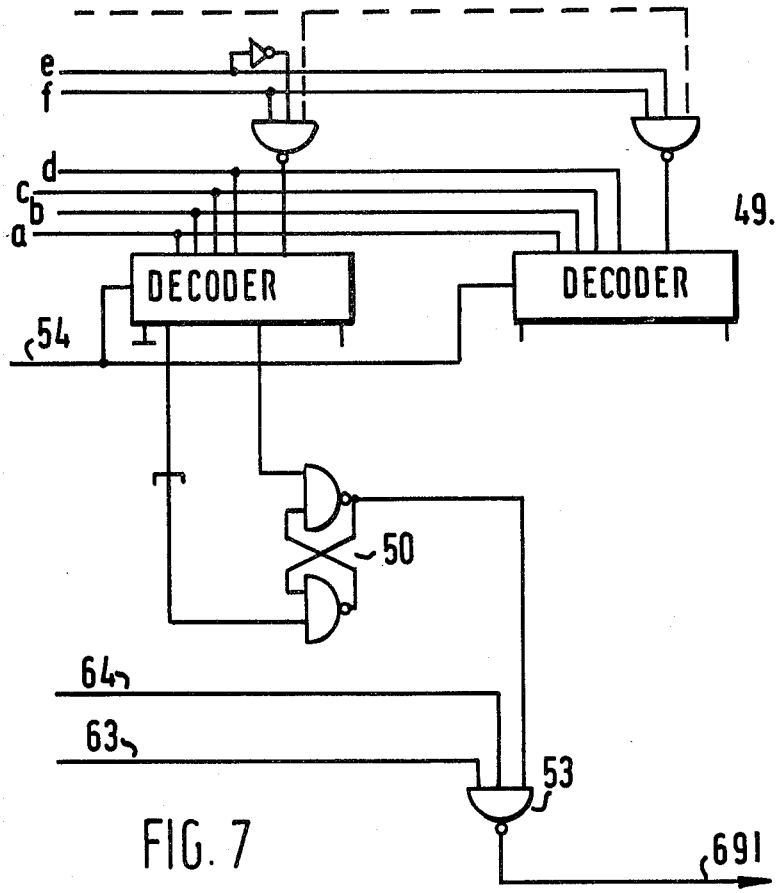
FIG. 7 is a detailed block circuit diagram of a stop-key demultiplexing, latching and gating arrangement of the unit of FIG. 2.

During that part of the scan which is reserved for dealing with the stop-keys the signals denoting 'on' channels are distributed by means of a demultiplexer 49 to a number of latches 50, one for each stop-key, composed of SN 7400 elements, which store the signals ready for use in conjunction with the keyboard signals. After dealing with the sync pulse and the thirty-two pedals, thirty-one channels remain available in the stops-and-pedals multiplexer (one of the multiplexers 12 of FIG. 1). Immediately after the highest pedal has been dealt with, the receiver resets the whole group of stop-key latches 50. This is achieved by using the first of the thirty-one channels as a permanent cancel signal; this method is advantageous when several groups of stop-keys become necessary and must be separately reset, as described later. A 'stops enable' line 54 runs from the keyboard decoder 66 to the demultiplexer 49 (FIGS. 5 and 7).

Immediately after the stop-key latches 50 have been reset a series of signals is received indicating which latches 50 are to be set on again. The demultiplexer 49 which distributes these signals (FIG. 7) is composed of two SN 74154's and is addressed directly from the counter 46 on address lines 52 as the question of alteration by the footage controller 51 does not arise for these signals. The arrangement will be apparent from FIG. 7, which also shows the stop-key gates 53 (SN 7410). The additional address line shown in broken lines is included when more than thirty stops are required.

When the stop-key latches 50 have been set it is necessary to combine these with the signals from the keyboards (manuals and pedals) in order to energise the desired pipes, with due recognition of the footage requirements.

Figure 6:
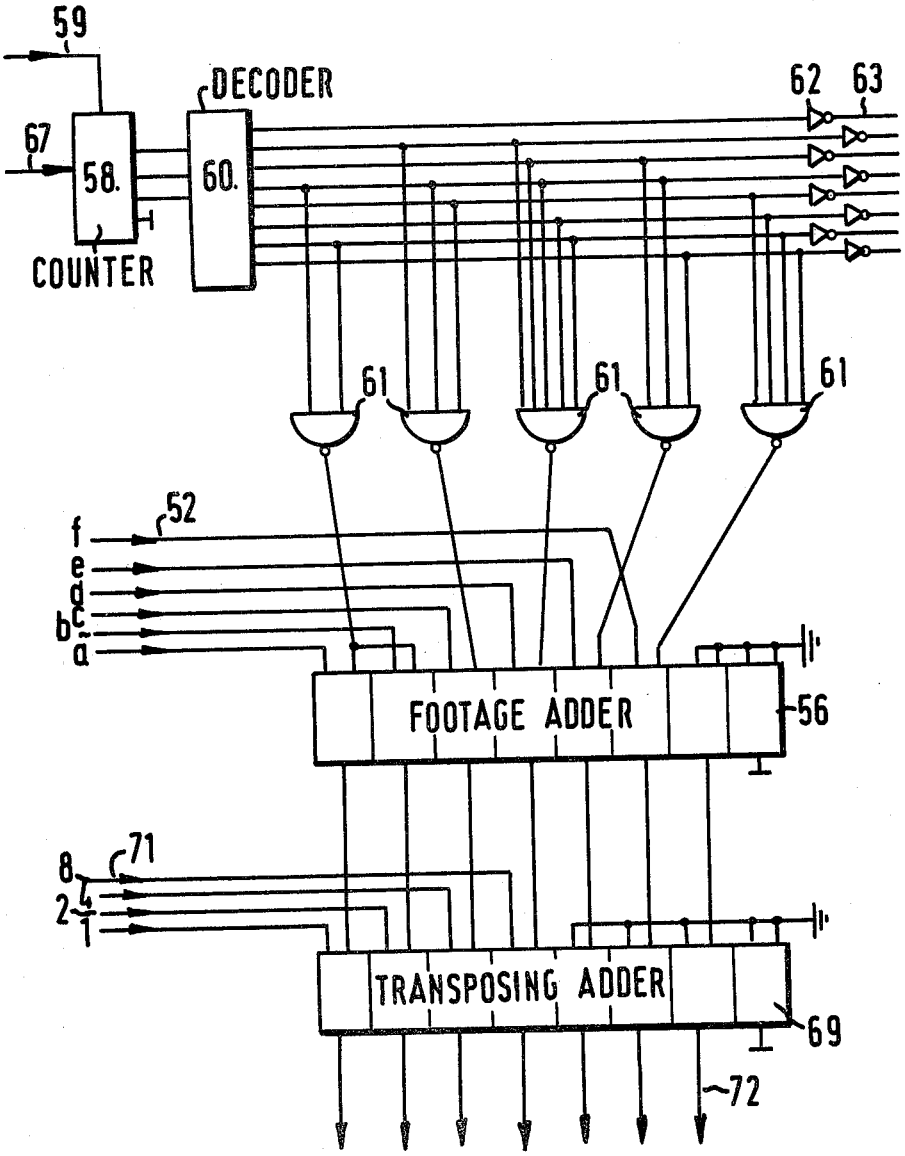
FIG. 6 is a detailed block circuit diagram of a footage control and transposing adder of the unit of FIG. 2.

The *a,b,c,d,e* and *f* digits of the receiver counter 46, which together define the address of a note of a keyboard, are connected to one set of inputs of an 8-digit binary adder 56 (two SN7483s) of FIG. 6. The other set of inputs of the adder 56 is under the control of the footage controller 51 as follows:

An oscillator 57 (see FIG. 5) similar to that in the console but designed to run at approx 200kHz drives a 4-digit binary counter 58 (SN7493) by a signal 59. The counter 58 provides a 3-digit address signal to a decoder 60 (SN74155). The fourth digit is not required unless more than eight different footages are to be provided, in which case a larger decoder would be needed (e.g. SN74154).

The decoder 60 has eight outputs which are thus energised in turn as the counter steps. A number of NAND-gates 61 are interposed between these outputs and the inputs to the adder 56 in such a way as to inject binary numbers into the adder 56 corresponding to the number of semitones by which the addresses of the pipes must be increased to achieve the desired footages. For the lowest pitch (longest footage, 16 feet) no addition is required; for the 8 feet pitch an addition of 12 is required and the corresponding decoder 60 output is connected to the NAND-gates 61 whose outputs are connected to the 3rd and 4th stage inputs of the adder 56, thus adding binary 00001100 (=12). Other decoder outputs deal with other footages similarly.

The order in which the footages are dealt with is not important but it is logical to arrange them in ascending order of pitch. The stepping rate must cover all the footages in the 50μS period but is otherwise not critical. Although not essential, it is preferred to stop the oscillator 57 and reset the counter between the 50μS pulses to facilitate observation with an oscilloscope.

Being supplied with the signals of the receiver's counter 46 on one set of inputs and the signals of the footage controller 51 on the other inputs, the outputs of the adder 56 show the address of the pipe corresponding to a selected note combined with a selected footage.

One input of each stop-key gate 53 (FIG. 7) is connected (each via an inverter 62 to obtain the necessary polarity and to obtain adequate 'fan-out') to the footage decoder output 63 for the footage which the stop-key is to provide. Thus the stop-key gate 53 can only open during the period of about 5μS when the appropriate footage addition is being made.

Another input of each stop-key gate 53 is connected each via a line 64 and on an inverter 65 (SN 7404) to a respective one of four outputs of a 'keyboard select' decoder 66 (SN74155) controlled by the *g* and *h* outputs of the receiver counter 46. This decoder 66 is also 'enabled' by line 67 on the detection of an incoming 'on' signal by timer 44 and strobed on line 68 by a 2μS pulse derived from the oscillator 57. The 'enable' signal on line 67 is also applied to a reset input 59 of the counter 58 (see FIG. 6).

Thus the stop-key gate is controlled by

1. The stop-key latch 50, showing whether the console stop-key is on.
2. The footage controller 51, selecting the required footage.
3. The keyboard select decoder 66, defining which keyboard the stop-key refers to.
4. The signal indicating that a note is 'on'.
5. A strobe signal which guards against overlapping during changes of address.

The stop-key gate 53 is opened only if all five requirements are fulfilled simultaneously. The output of the gate 53 is connected to the individual control wire 691 of the rank of pipes to which the stop-key relates. 3-input NAND-gates with open collectors (SN7412) are used for stop-key gates to allow paralleling of outputs, as several stop-keys may control the same rank.

"Mixture stops", in which one stop-key brings into use several different footages simultaneously, may be provided either by using several stop-key gates, one for each required footage, or by combining the required footage controller outputs in an OR gate whose output controls a single stop-key gate.

It is particularly to be noted that a single 3-way gate (the component cost of which is trivial) performs the functions of 61 pairs of relay contacts or 61 2-way diode gates and their associated complex wiring in earlier systems. This enables the function of a stop-key to be changed by re-arranging one wire instead of 61. Additions can be made with corresponding ease and provision can be made at the outset, at trivial cost, for future expansion of the instrument.

In addition to the footage modifying adder 56, a transposing adder 69 (FIG. 6) is provided which is composed of two SN 7483's. This receives inputs from the adder 56, and inputs 71 from stop-key latches 50. Outputs of the adder 69 are fed on address lines 72 to the pipe magnet demultiplexers 74 shown in detail in FIG. 8.

Figure 8:
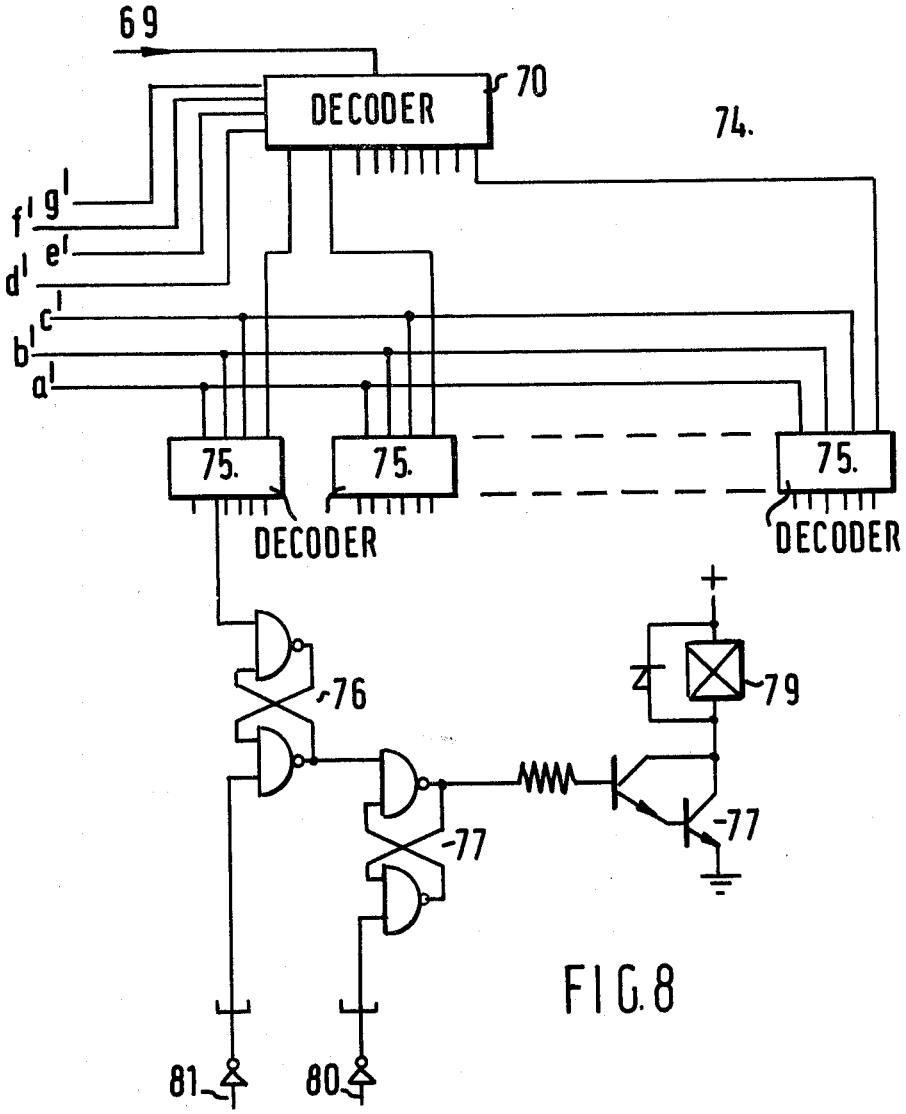
FIG. 8 is a detailed block circuit diagram of part of the unit of FIG. 2, showing a pipe magnet demultiplexer, with latches and drivers for one pipe rank.

FIG. 8 shows the arrangement of the demultiplexer 74 for a rank and the double latch 76, 77 and driver transistors 78 for each pipe magnet 79. The demultiplexer 74 is a straightforward combination of a decoder 70 (SN74154) and a plurality of decoders 75 (SN 74155), the demultiplexer being addressed by the seven outputs of the footage and transposition adders 56 and 69. It is capable of selecting any one of 128 pipes. This is more than adequate; ranks are rarely more than 97 pipes, never more than 109.

The outputs of the demultiplexers 74 are connected to the double latches 76, 77, one set of these latches for each pipe. Due to the fact that any pipe may be signalled at several different points in the scan, a single latch would not suffice. When a pipe is signalled 'on' a pulse from the demultiplexer 74 sets latch 76 and the output of latch 76 immediately sets latch 77 which energises the pipe magnet 79 via driver transistor(s) 78.

Once set, the latches 76, 77 remain on until cancelled by the reset pulses on lines 80 and 81 from the receiver. These pulses are generated during the period when the scan is dealing with the stop-key channels. It is important that these should not overlap and a discrete interval is left between them. The pulse on line 80, occuring first, is applied to the reset line of all latches 77 but can only reset those whose corresponding latches 76 have previously been reset and not set again during the last scan. After the end of the pulse on line 80, the pulse on line 81 resets the latches 76. Thus latch 77 is cancelled only when a complete scan has occurred in which there has been no signal to indicate that the pipe is required to remain on.

The reset pulses are supplied to the lines 80 and 81 by an arrangement 83 (SN 7420) and inverters 84 receiving signals from the address lines *d, e* and *f* of the counter 46 and a keyboard select line from the keyboard decoder 66 (FIG. 5).

Further facilities additional to the basic facilities described above will now be referred to.

Interkeyboard coupling. Basically, each keyboard is associated with a 'department' of the organ controlled by a group of stop-keys. (The departments are conventionally variously referred to as Great, Choir, Swell, Solo, Echo, Pedal, Accompaniment, and so on. It will suffice for the present purpose to refer to them as A, B, C, . . . .). However, it is often desired to control a department from a different keyboard. In principle a department could be coupled to all keyboards at will, but the cost of providing the comprehensive facility has hitherto been prohibitive.

In the new system the function of a given keyboard in controlling different departments depends solely on the part of the scan for which the keyboard common line is energised. This can be varied at trivial cost by a system of gates shown the keyboard coupler 21 in FIG. 3. The keyboard selector 16 provides four signals in time sequence corresponding to the four departments catered for in this embodiment. These are used to energise any or all of the keyboard lines 29 by connecting to the appropriate gate 84 (SN7420) directly or via control switches 84 shown diagrammatically in FIG. 3.

Interval coupling. This refers to the coupling of notes a fixed distance apart on a given keyboard, most commonly an 'octave' apart. Hitherto this has required a multi-contact relay coupling each pair of notes separately, with a further complication to avoid unwanted through coupling. In the present system such coupling is easily achieved at the console by the use of 5-stage shift registers (SN7496) or similar, indicated by reference numeral 13 in FIG. 1.

Binary signals applied to the input in such a register are shifted along one stage each time the 'clock' terminal is pulsed and outputs may be taken from any of the five stages. The registers may be connected in tandem to provide any desired number of stages.

The shift registers 13 are connected, as shown in FIG. 1, between the keyboard combiner 11 and the modulated oscillator 10. Switches and gates (not shown) are provided to allow signals to be taken from the appropriate shift register stages and mixed to provide the signal to the modulator. Octave coupling requires a shift of 12 notes and consequently needs three SN7496s; four will allow the shift of 19 notes required for coupling 'twelfths'. The drive for the 'clocking' of the registers is taken from the driving oscillator. Intermediate intervals may be obtained from the intermediate stages of the shift registers; repeated intervals extending to the whole range of the keyboards may be obtained by back-coupling the 12th stage (i.e. the 'octave') to the input.

In the position shown in FIG. 1 the interval coupler 13 can be effective on all departments. Gates (not shown) controlled by the keyboard selector allow the coupling to be restricted to specified departments. To prevent spill-over from the top of one keyboard to the bottom of the next in order of scan a 'clear' signal is applied to the registers at the end of each keyboard scan.

With the shift registers 13 in the position shown in FIG. 1 it is not possible to distinguish which keyboard the signals come from (only which department). If it is desired to control on a keyboard basis, separate shift registers can be inserted between the keyboard multiplexers 12 and the keyboard combiner 11.

Sub-octave coupling requires that normal signals be delayed by a 12-stage register so that sub-octave signals can be obtained by anticipating the normal signals.

With all variations of the interval coupler, arrangements are made to disable the coupling during the part of the scan allotted to stop-keys.

Second touch. It is sometimes arranged that increased pressure on the notes of the keyboards operates an extra contact to bring into effect additional stops. While this could be treated as equivalent to an extra keyboard, it is more economical of scanning time to arrange that two modulators are used, one expanding the oscillator unit period by, say, 50% and the other by, say, 100%. At the receiver, separate timers discriminate between these and generate signals which are processed separately via appropriate stop-key latches and gates. This method avoids wasting scanning time on a little-used facility.

Transposition. The transposition of music into different 'keys' — often required when accompanying singers — merely requires the shifting of all notes up (or down) a fixed number of semitones. One method of achieving this is shown in FIG. 6. Four signal channels 71 leading to the adder 69 are used to add 1, 2, 4, or 8 or any combination of these, to the address supplied to the pipe demultiplexers on address lines 72. This allows upward transposition by up to 15 semitones. If downward transposition is required a fifth channel (not shown) is used to give an addition of 112 (128-16). As the eighth binary digit is ignored, this is equivalent to subtracting 16; the other four channels are then used to raise the pitch to that desired. False transpositions to high pitches do not occur because there are no pipes in the number range 112 to 128.

An alternative method of transposition is by an obvious adaptation of the interval coupler 13 described above.

Split keyboards. To avoid the considerable expense of providing additional keyboards, any keyboard may be split so that the lower half plays one department of the organ while the upper part plays a different department. In the new system this is achieved by placing the keyboard coupler gates 84 (FIG. 3) under the additional control of signals generated when the scan reaches the desired point of split. Any point can be specified as a binary address and a multi-way gate appropriately connected throws over a bistable latch which changes the keyboard coupling until it is reset at the end of the keyboard scan. The binary address may be permanently wired or may be selected at will. A convenient method which allow setting by the organist is by using a 6-stage binary memory (e.g. 6 bistable latches) which is set by 'playing' a single note on the manual while holding a 'set-split' switch. The change of department is then made each time the scanner passes through the address held in the memory.

Harmony extension. The harmonies that can be played by an organist are normally limited in their range of pitch by the number of keyboard notes that can be encompassed by his finger-span. For example, intervals of a 'tenth' are often desirable but are beyond the span of a small hand.

An extension of the interval coupler system 13 described above enables the organist to sound harmonies beyond an octave interval by playing, on the keyboard, the corresponding interval within an octave (e.g. a 'third' in place of a 'tenth'). A one-stage binary counter (i.e. a divide-by-two) is arranged to be driven by each note of a keyboard which is 'on'. This is easily done by arranging that the divide-by-two counter is driven by the scanning oscillator gated by the combined-keyboards signal, with re-set at the beginning of each keyboard scan. In one of its two states the divide-by-two counter connects the interval coupler 13 to transmit only direct (unison) signals while in its other state it disables unison and enables the octave coupler. Thus the upper of any two notes played is raised by an octave. More complex chords (harmonies) have alternate notes raised by an octave thus opening the harmony.

Inter-department duets on one manual. This is a variation of the harmony extension described above. Instead of controlling unison and octave of one department the divide-by-two counter switches between unison, or octave, control of two different departments via either the interval coupler 13 or the keyboard coupler 21. Thus alternate notes of a chord sound different ranks as set up on the stops of the different departments.

Arpeggiators and other note-pattern generators. The interval couplers 13 described above, using shift registers, enable any note differing by a specified interval from a note played to be brought into effect. By controlling selected interval couplings by appropriate timed signals a predetermined pattern of notes based upon a played note may be generated. The required pattern may be stored in a read-only memory such as SN74188 or recorded by the organist in a read-and-write memory such as SN74200. Arpeggios or other musical sequences may thus be generated automatically.

Sustain. It may be arranged that pipes, once energised, remain so after release of the playing key until cancelled by the organist. It is only necessary to disconnect the pulse on line 80 or 81 (FIG. 8) (or both) from those pipes which it is desired to sustain; this may be done by means of a stop-key channel controlling a suitable gate in the path of these pulses to the pipes to be sustained.

Atonal effects. It is sometimes required to play drums or similar atonal effects from a keyboard irrespective of the note played. This is easily arranged by a gate which connects the 'on' signal to a latch for the duration of a keyboard scan.

Recording and playback.

Recording is effected by applying the signal on line 18 (FIG. 1) to a set of inverters (SN7404) not shown, to provide a balanced push-pull signal which is applied directly to a magnetic recording head of suitable low impedance in the tape recorder 17. No recording high frequency bias is necessary but it is desirable to erase previous signals and to put the tape in a neutral magnetic state by means of an AC erase head in the manner generally used for audio recording.

The tape is played back through a simple preamplifier without low-frequency compensation being necessary. In the interest of fast response of the whole system it is necessary to make full use of the high-frequency capabilities of the recorder and some high frequency compensation is usually needed. Automatic gain control may also be used with advantage to compensate for minor tape variations, as the amplitude of the recording is constant.

In place of the square-wave recording signal, the played-back signal contains little more than the fundamental sinusoidal component of the original line signal. The required information is contained in the timing of the signals and this is retrieved by applying the amplified signal to a double peak detector which produces pulses on the positive and on the negative peaks. These pulses respectively set and reset a bistable circuit whose output gives the necessary squared output for transmission to the receiver in the pipe chamber.

It will be appreciated that tapes encoded on a particular organ can be played back on any other organ using the same encoding scheme. For playback on organs using a different encoding scheme, tapes can readily be translated from one encoding scheme to another using computer techniques.

Modification of played-back music.

Arrangements can be made to mix 'live' signals from the console with signals from the playback of a tape. The normal driving oscillator 10 of the console multiplexer is disabled and instead the console counter 14 is driven from the tape signals in exactly the same way as the pipe-chamber receiver, including synchronisation. Signals from the console keyboards and stop-keys are then available from the keyboard combiner 11, but cannot be directly mixed with the playback signals because of their time-modulated nature. The keyboard combiner 11 is therefore arranged to apply signals to either or both of two additional wires to the pipe-chamber, an 'add' wire and a 'delete' wire. At the pipe-chamber these signals are mixed with the decoded time signals via gates so that in the one case they are mixed additively and in the other case subtractively, so that according to which of the two extra lines is used the console can add to or delete from the recorded signals.

The ability to add or delete applies to both keyboard notes and stop-keys. It is therefore possible, for example, to delete all signals intended for any specified department of the organ and replace them with newly-generated signals. Similarly any or all of the stop-key signals can be deleted and replaced thus permitting the registration to be changed while retaining the keyboard signals.

I claim:

1. A pipe organ comprising a pipe sounding section having a rank of pipes for sounding musical notes, a note playing section having a plurality of playing keys allocated to individual notes and operable by a player of the organ, and a plurality of stops operable by the player of the organ for selecting desired correlations between keys played and pipes to be sounded, one of said stops selecting a given basic pitch relationship desired between the keyboard and the pipes, others of said stops selecting other pitch relationships desired between the keyboard and the pipes, said organ comprising time-division multiplex means for cyclically electrically sensing the operative conditions of the stops and keys and providing a multiplex signal representative of the operative condition of the organ at any time, means for transmitting the signal to the pipe sounding section of the organ, store means allocated to the individual stops, means for operating the store means from said signal to cause said store means to store sensed operative conditions of the stops, means for modifying the signal, said modifying means being means which are operable during each time-division multiplex stop that a key operative condition is being sensed and which modify the signal a number of times equal to the number of said pitch relationships whereby said modified signal successively represents the address of a pipe having said basic pitch relationship to the playing key being sensed, and the addresses of pipes having said other pitch relationships to the playing key being sensed, means for de-multiplexing the modified signal and means for controlling individual pipes in response to the signals from the de-multiplexing means, in accordance with the sensed operative conditions of the keys, there being gate means for each said desired pitch relationship, each said gate means having a plurality of inputs, there being means activating one said input in accordance with the playing key being sensed having been depressed, means activating another of said inputs from the store means allocated to a stop selecting and pitch relationship to which said gate means is allocated, means activating another of said inputs during the time period when the modifying means is effecting a modification of said signal appropriate to the pitch relationship to which said gate means is allocated, each said gate means having an output for enabling operation of said pipes by said pipe controlling means when all inputs of a given gate means are simultaneously activated.

2. A pipe organ according to claim 1, wherein said pipe sounding section has a plurality of ranks of pipes and said note playing section comprises a plurality of keyboards, a plurality of pedals and a plurality of stops, said stops selecting desired correlations between keys played and pipes to be sounded and selecting desired ranks or combinations of ranks, said multiplex means cyclically electrically sensing the operative conditions of all of the keys, pedals and stops, there being one said gate means per desired pitch relationship per keyboard per pipe rank.

3. A pipe organ according to claim 1, wherein said signal is a binary digital signal and said modifying means is a multi-stage binary adder, there being means for injecting binary numbers successively into the adder for addition therein to the said signal whereby to provide the successive modification of said signal.

4. A pipe organ according to claim 3, comprising a further multi-stage binary adder having first inputs connected to the outputs of the first said adder and having further inputs connected to the store means allocated to certain of the stops, said further adder effecting further modifications of said signal so as to change the pipe addresses represented by said signal by amounts related to the said certain stops, whereby to provide transposition of the musical-key.

5. An organ according to claim 2, comprising keyboard selecting means for selectably placing at least one keyboard in a sensible state during a scanning time period allocated to another of the keyboards, whereby to enable a keyboard to sound notes which are proper to other keyboards.

6. An organ according to claim 5, wherein the keyboard selecting means also selectably provide keyboard-to-pedal coupling.

7. An organ according to claim 5, wherein said keyboard selecting means include keyboard coupler gates controllably performing the inter-keyboard switching.

8. An organ according to claim 7, comprising means for changing the inter-keyboard coupling at a given predetermined point in a keyboard scan, whereby to enable effective splitting of a keyboard at said point, with that part of the keyboard at one side of said point playing a pipe department appropriate to a different keyboard.

9. An organ according to claim 1, comprising a magnetic tape recorder for recording a signal representative of said multiplex signal for use in re-creation of said multiplex signal for supply to the pipe sounding section of the organ at a later time.

10. An organ according to claim 9, wherein said note playing section is operative during re-creation of said multiplex signal by means of the note playing section of the organ.

11. An organ according to claim 9, comprising a magnetic tape playback means for supplying said multiplex signal to said pipe sounding section of the organ by playback of a prerecorded tape.

* * * * *